US006421017B1

(12) United States Patent
Inoue

(10) Patent No.: US 6,421,017 B1
(45) Date of Patent: Jul. 16, 2002

(54) ON-BOARD DSRC APPARATUS

(75) Inventor: Masahiro Inoue, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/703,590

(22) Filed: Nov. 2, 2000

(30) Foreign Application Priority Data

Apr. 14, 2000 (JP) ..... 2000-113568

(51) Int. Cl.[7] ..... H01Q 1/32
(52) U.S. Cl. ..... 343/713; 343/711
(58) Field of Search ..... 343/713, 711, 343/712; 340/425.5, 438, 572, 825

(56) References Cited

U.S. PATENT DOCUMENTS 6,005,527 A * 12/1999 Gomez et al. ..... 343/713
6,061,029 A * 5/2000 Hisada ..... 343/713
6,144,343 A * 11/2000 Furuya et al. ..... 343/713
6,175,791 B1 * 1/2001 Oouchi ..... 701/36
6,275,157 B1 * 8/2001 Mays et al. ..... 340/572.5

* cited by examiner

*Primary Examiner*—Don Wong
*Assistant Examiner*—Hoang Nguyen
(74) *Attorney, Agent, or Firm*—Sughrue Mion, PLLC

(57) ABSTRACT

The present invention provides an on-board DSRC apparatus in which the reduction of the antenna characteristics is prevented. The on-board DSRC apparatus includes an antenna and a control unit for communicating with the associated one of on-road communication machines which is installed on a travelling road of a vehicle and being installed in the vicinity of a dash-board of a vehicle, wherein positioning means is provided between the antenna and a front glass part of a vehicle so that a distance between the antenna and the front glass part of the vehicle is set to a fixed value.

15 Claims, 4 Drawing Sheets

ON-BOARD DSRC APPARATUS

BACKGROUND OF THE INVENTION

1. Field of the Invention

The present invention relates in general to an on-board DSRC (Dedicated Short-Range Communication) apparatus for use in ETC (Electronic Toll Collection) systems or the like of ITS (Intelligent Transport Systems), and more particularly to an on-board DSRC apparatus in which the degradation of the antenna characteristics due to the change in the peripheral state of an antenna is prevented.

2. Description of the Related Art

In general, in an on-board DSRC apparatus (hereinafter, it is also referred to as "an on-board apparatus " for short, when applicable), an antenna for transmission and reception of an electric wave is installed (placed or embedded) in the vicinity of a front glass part and a dash-board in order to communicate effectively with the associated one of antenna of on-road communication machines for charge collection.

FIG. 5 is a side view showing the installation state of a conventional on-board DSRC apparatus, and FIG. 6 is a front view of the conventional on-board apparatus when viewed from the inside of a vehicle. In these figures, there is shown the case of the on-board apparatus which is installed after having purchased the vehicle.

In FIGS. 5 and 6, an on-board apparatus 1 is installed on a dash-board 2 and also firmly fixed thereto in such a way as to be readily viewed by a driver.

A front glass part 3 of the vehicle is provided over the dash-board 2 and also the front face of the dash-board 2 is provided with a steering wheel 4, a speed meter 5 and the like.

An antenna and a control unit (both not shown) are provided in the inside of the on-board apparatus 1 in order to communicate with the associated one of on-road communication machines for charge collection (not shown) which is installed on the travelling road of the vehicle.

The antenna is provided on the upper side of the on-board apparatus 1 and has the directivity towards an antenna of the associated one of the on-road communication machines for charge collection (located above the road).

While the on-board apparatus 1, as shown in FIGS. 5 and 6, may be purchased in a shop for selling products for vehicles to be installed on the dash-board 2, a vehicle may be sometimes equipped with the on-board apparatus in accordance with the standards when having sold the vehicle, or otherwise the on-board apparatus 1 may be embedded in the dash-board 2 as a result of purchasing an option.

In the on-board apparatus 1 constructed as described above, its antenna characteristics (relating to the reflection of an electric wave, the speed and the like) are changed in dependence on a dielectric constant and a thickness of an object (the front glass part 3 or the like) which is present in front of the antenna, and a distance between the antenna and the object which is present in front of the antenna.

Therefore, there is the possibility that the performance of the antenna characteristics (the resonance frequency, the polarized wave characteristics, the antenna gain and the like) may be degraded due to the influence of the object which is present in front of the antenna.

In particular, in such an on-board apparatus 1, since the antenna for the circularly polarized wave is employed and also the characteristics are easy to be degraded due to a dielectric constant and a thickness of an object which is present in front of the antenna, it is impossible to disregard. the change in the peripheral state of the on-board apparatus 1.

In addition, in the case where the antenna of the on-board apparatus 1 is already embedded in the dash-board 2 when purchasing a vehicle, since it is difficult for a driver to recognize the position of the antenna, a baggage is easy to be unpreparedly placed on the on-board apparatus 1. As a result, the situation in which the desired antenna characteristics may not be obtained is easy to occur.

As described above, in the conventional on-board DSRC apparatus, there arises the problem that in the case where a driver installs the on-board DSRC apparatus on the dash-board, the characteristics of the antenna (the resonance frequency characteristics, the polarized wave characteristics, the antenna gain and the like) may be degraded due to a distance between the antenna and an object (the front glass part) which is present in front of the antenna and a dielectric constant, so that the desired antenna characteristics are not obtained.

In addition, in the case where a driver places unpreparedly a baggage on the upper part of the antenna, there arises the problem that the desired antenna characteristics may not be obtained due to a dielectric constant and a thickness of the object (the baggage) placed on the upper part of the antenna.

SUMMARY OF THE INVENTION

In the light of the foregoing, the present invention has been made in order to solve the above-mentioned problems associated with the prior art, and it is therefore an object of the present invention to provide an on-board DSRC apparatus in which the degradation of the antenna characteristics is prevented by adopting the construction in which it is difficult for any of objects to lie between an antenna of the on-board apparatus and a front glass part of a vehicle.

According to one aspect of the present invention, there is provided an on-board DSRC apparatus including an antenna and a control unit for communicating with the associated one of on-road communication machines which is installed on a travelling road of a vehicle and being installed in the vicinity of a dash-board of a vehicle, wherein positioning means is provided between the antenna and a front glass part of a vehicle so that a distance between the antenna and the front glass part o:f the vehicle is set to a fixed value.

According to another aspect of the present invention, there is provided an on-board DSRC apparatus wherein the positioning means is comprised of a dielectric part having a predetermined dielectric constant so that the antenna characteristics are ensured to predetermined values.

In addition, according to still another aspect of the present invention, there is provided an on-board DSRC apparatus wherein the matching is obtained for the antenna of the on-board DSRC apparatus by taking a thickness and a dielectric constant of the dielectric part into consideration.

In addition, according to yet another aspect of the present invention, there is provided an on-board DSRC apparatus wherein the positioning means is projectingly provided in the on-board DSRC apparatus in such a way as to be located in the vicinity of the peripheral part of the antenna.

In addition, according to a further aspect of the present invention, there is provided an on-board DSRC apparatus wherein the antenna is installed on the dash-board of the vehicle and the positioning means is provided up to the position which reaches the front glass part of the vehicle.

Also, according to an even further aspect of the present invention, there is provided an on-board DSRC apparatus wherein the positioning means has a printing display part on the surface facing a driver of the vehicle.

Also, according to another aspect of the present invention, there is provided an on-board DSRC apparatus wherein the on-board DSRC apparatus is installed in such a way as to be adhered closely to an inner wall of the front glass part of the vehicle.

Also, according to still another aspect of the present invention, there is provided an on-board DSRC apparatus wherein the control unit transmits and receives information relating to the charge collection to and from the associated one of the on-road communication machines for charge collection to carry out automatically the charge collection on the basis of the information relating to the charge collection.

In addition, according to yet another aspect of the present invention, there is provided an on-board DSRC apparatus including an antenna and a control unit for communicating with the associated one of on-road communication machines which is installed on a travelling road of a vehicle and being installed in the vicinity of a dash-board of a vehicle, wherein the antenna is embedded in the dash-board, and the dash-board has a projecting member on a upper face corresponding to the position where the antenna is embedded.

In addition, according to a further aspect of the present invention, there is provided an on-board DSRC apparatus wherein the projecting member is provided in the position corresponding to the peripheral part of the antenna.

In addition, according to an even further aspect of the present invention, there is provided an on-board DSRC apparatus wherein the projecting member has a printing display unit on the surface facing a driver of the vehicle.

Also, according to another, aspect of the present invention, there is provided an on-board DSRC apparatus wherein the control unit transmits and receives information relating to the charge collection to and from the associated one of the on-road communication machine s for charge collection to carry out automatically the charge collection on the basis of the information relating to the charge collection.

Also, according to still another aspect of the present invention, there is provided an on-board DSRC apparatus including an antenna and a control unit for communicating with the associated on e of on-road communication machines which is installed on a travelling road of a vehicle and being installed in the vicinity of a dash-board of a vehicle, wherein the antenna is embedded in the dash-board, and the dash-board has a printing display unit on a upper face corresponding to the position where the antenna is embedded.

Also, according to yet another aspect of the present invention, there is provided an on-board DSRC apparatus wherein the control unit transmits and receives information relating to the charge collection to and from the associated one of the on-road communication machines for charge collection to carry out automatically the charge collection on the basis of the information relating to the charge collection.

BRIEF DESCRIPTION OF THE DRAWING

The above and other objects as well as advantages of the present invention will become clear by the following description of the preferred embodiments of the present invention with reference to the accompanying drawings, wherein.

DETAILED DESCRIPTION OF THE PREFERRED EMBODIMENTS

The preferred embodiments of the present invention will hereinafter be described with reference to the accompanying drawings.

(First Embodiment)

A first embodiment of the present invention will hereinbelow be described with reference to FIG. 1.

Figure 1:
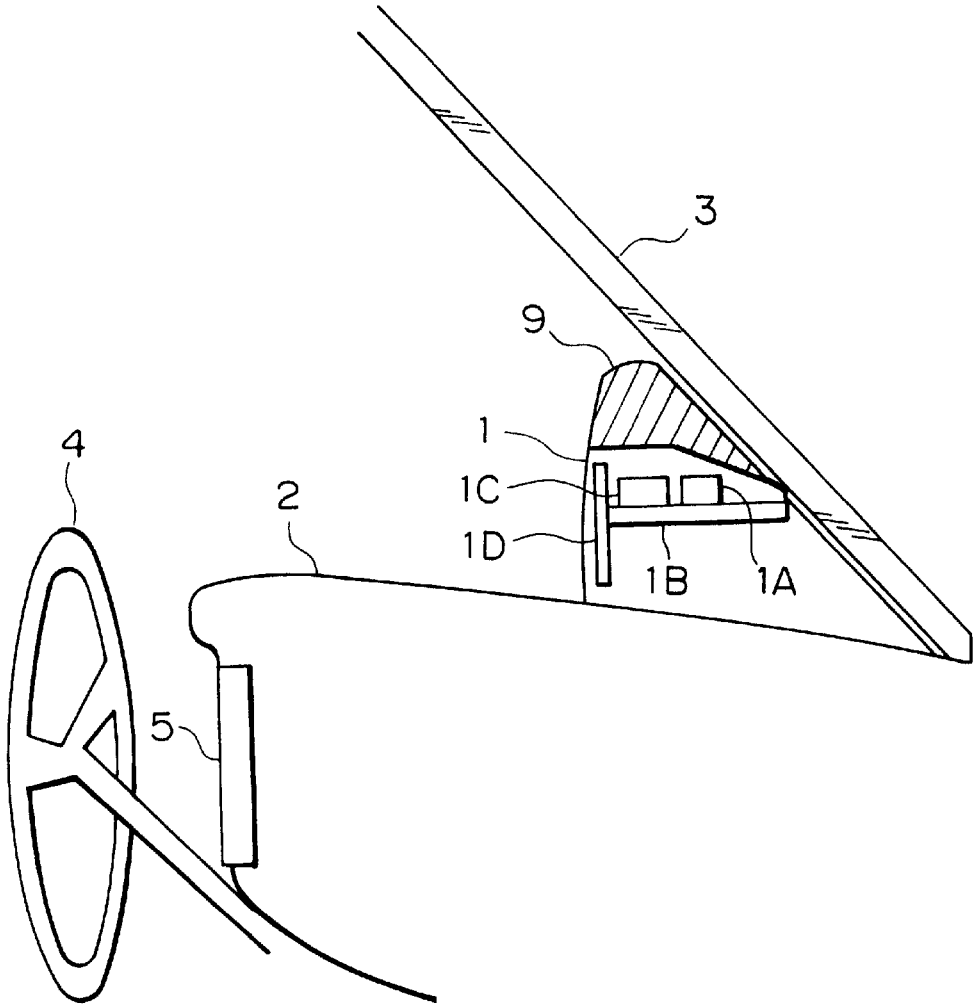
FIG. 1 is a longitudinal cross sectional view showing an installation state of an on-board DSRC apparatus according to a first embodiment of the present invention.

FIG. 1 is a longitudinal cross sectional view showing an installation state of an on-board DSRC apparatus according to the first embodiment of the present invention.

Figure 5:
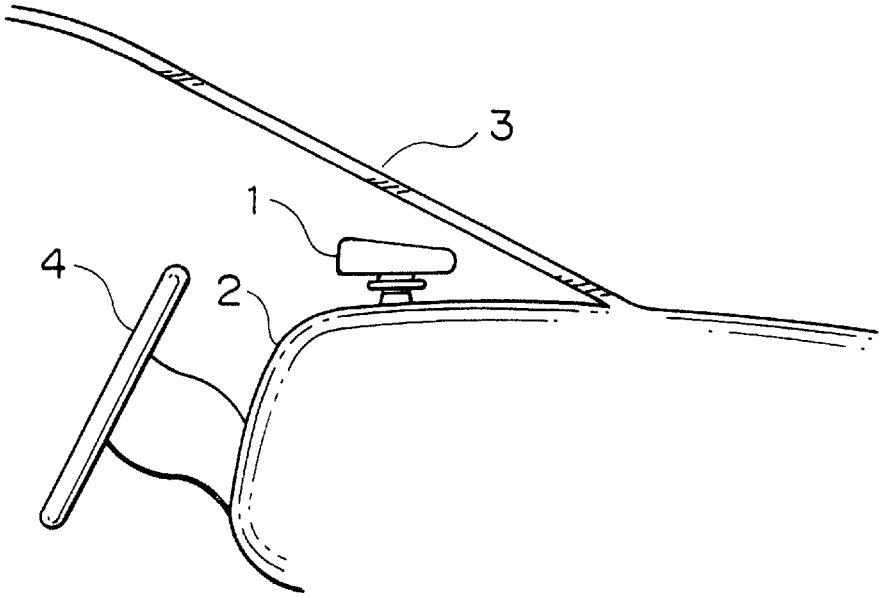
FIG. 5 PRIOR ART
FIG. 5 is a side elevational view showing an installation state of a conventional on-board DSRC apparatus.
Figure 6:
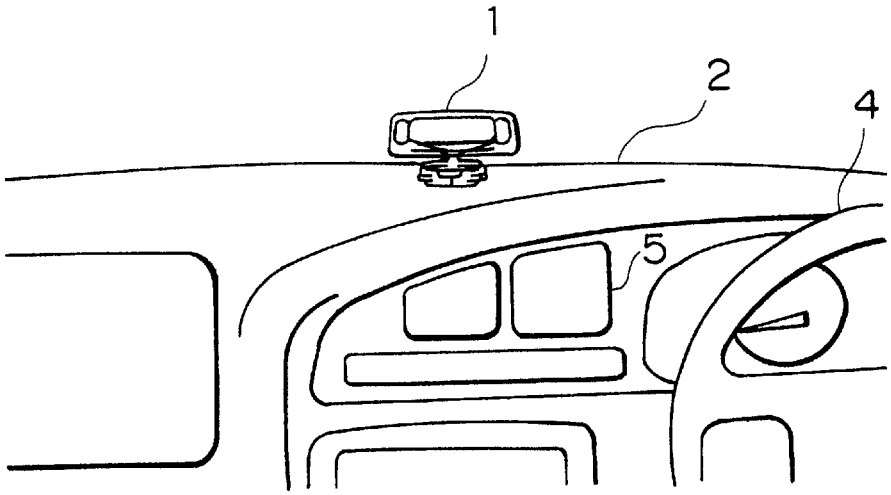
FIG. 6 PRIOR ART
FIG. 6 is a front view showing the installation state of the conventional on-board DSRC apparatus when viewed from the inside of a vehicle.

In FIG. 1, parts similar to those previously described with reference to FIGS. 5 and 6 are designated by the same reference numerals and the detailed description thereof is omitted here for the sake of simplicity.

In addition, in the present embodiment, the description will hereinbelow be given by taking as an example an on-board ETC (Electronic Toll Collection) apparatus with which the charge collection is automatically carried out in a toll road.

An on-board apparatus 1 has an antenna 1A through which the on-board apparatus 1 communicates with the associated one of on-road communication machines for charge collection. The antenna 1A is installed on a board 1B in the on-board apparatus 1.

In addition, a control unit 1C and a display unit 1D are both installed on the board 1B.

The control unit 1C drives the antenna 1A to transmit and receive information relating to the charge collection to and from the associated one of the on-road machines for charge collection to automatically carry out the charge collection on the basis of the information relating to the charge collection and also if necessary, to compel the display unit 1D to display thereon the information relating to the charge collection, and the like.

The display unit 1D is provided on the side face of the on-board apparatus 1 in such a way as to be directed to a driver.

A dielectric part 9 having a predetermined dielectric constant is provided as positioning means for the on-board apparatus 1 between the antenna 1A and a front glass part 3.

The dielectric part 9 is provided up to the position, which reaches the front glass part 3, over the antenna 1A to set a distance between the antenna 1A and the front glass part 3 to a fixed value in such a way that the characteristics of the antenna 1A are ensured to predetermined values.

In this connection, while not illustrated in the figure, an external storage medium such as an IC card is connected to the on-board apparatus 1. In addition, a sound outputting unit or the like, in addition to the display unit 1D, is connected as an output unit of the on-board apparatus 1 to the on-board apparatus 1, while a switch which can be manipulated by a user or the like is provided as an input unit of the on-board apparatus 1.

By adopting the construction as described above, since the on-board apparatus 1 is fixed to the predetermined position with respect to the front glass part 3, the peripheral state of the on-board apparatus 1 is maintained unchanged so that the characteristics of the antenna 1A are not degraded at all.

In addition, since the upper space of the on-board apparatus 1 is filled with the dielectric part 9, a driver is prevented from placing carelessly a baggage in the space defined between an installation part (the dash-board 2) of the on-board apparatus 1 and the front glass part 3. Therefore, it is possible to prevent the degradation of the characteristics of the antenna 1A which is caused by the interposition of an object therebetween.

That is, when the positional relation between the antenna 1A of the on-board apparatus 1 and the front glass part 3 is fixed, the peripheral conditions of the on-board apparatus 1 become all known which are constituted by a thickness t1 and a dielectric constant $\in$ 1 of the space in the on-board apparatus 1, a thickness t9 (corresponding to a distance between the on-board apparatus 1 and the front glass part 3) and a dielectric constant $\in$ 9 of the dielectric part 9, and a thickness t3 and a dielectric constant 3 of the front glass part 3.

Therefore, the matching can be obtained in the highest state for the antenna 1A by taking into consideration the thicknesses t1 to t3 and the dielectric constants $\in$ 1 to $\in$ 3 in such a way that an overall dielectric constant $\in$ in front of the antenna 1A is not changed at all, the degradation of the characteristics of the antenna 1A due to the reflection of the electric wave from the front glass part 3 is prevented, and also the characteristics of the antenna 1A can be brought out to a maximum.

In such a way, the antenna 1A and the dielectric part 9 (the object which is present in front of the antenna 1A) are both fixed and the matching is obtained for the antenna characteristics which are influenced by the dielectric constant $\in$ 9 and the thickness t9 (corresponding to the distance between the dielectric part 9 and the front glass part 3) of the dielectric part 9, and the like to make the antenna characteristics the maximum state, whereby it is possible to carry out the stable DSRC communication.

In general, a patch antenna is employed as such an antenna 1A of the on-board apparatus 1, and the matching for the antenna 1A is obtained by the cutting of the resonance pattern constituting the antenna 1A, the LC matching in the feeder line leading to the antenna 1A, or the like.

While in the present embodiment, the on-board ETC apparatus is employed as the on-board DSRC apparatus, and under this condition, the description has been given by taking as an example the case where the on-board ETC apparatus exchanges the information relating to the charge collection with the associated one of the on-road communication machines for charge collection to carry out automatically the charge collection, even when the present invention is applied to any of other on-board DSRC apparatus, the same operation and effects can be obtained.

(Second Embodiment)

In addition, while in the above-mentioned first embodiment, the dielectric part 9 as the positioning means for the on-board apparatus 1 is provided in such a way as to fill in the upper space of the antenna 1A, alternatively, the dielectric part 9 may also be provided only in the peripheral part of the antenna 1A.

(Third Embodiment)

Figure 2:
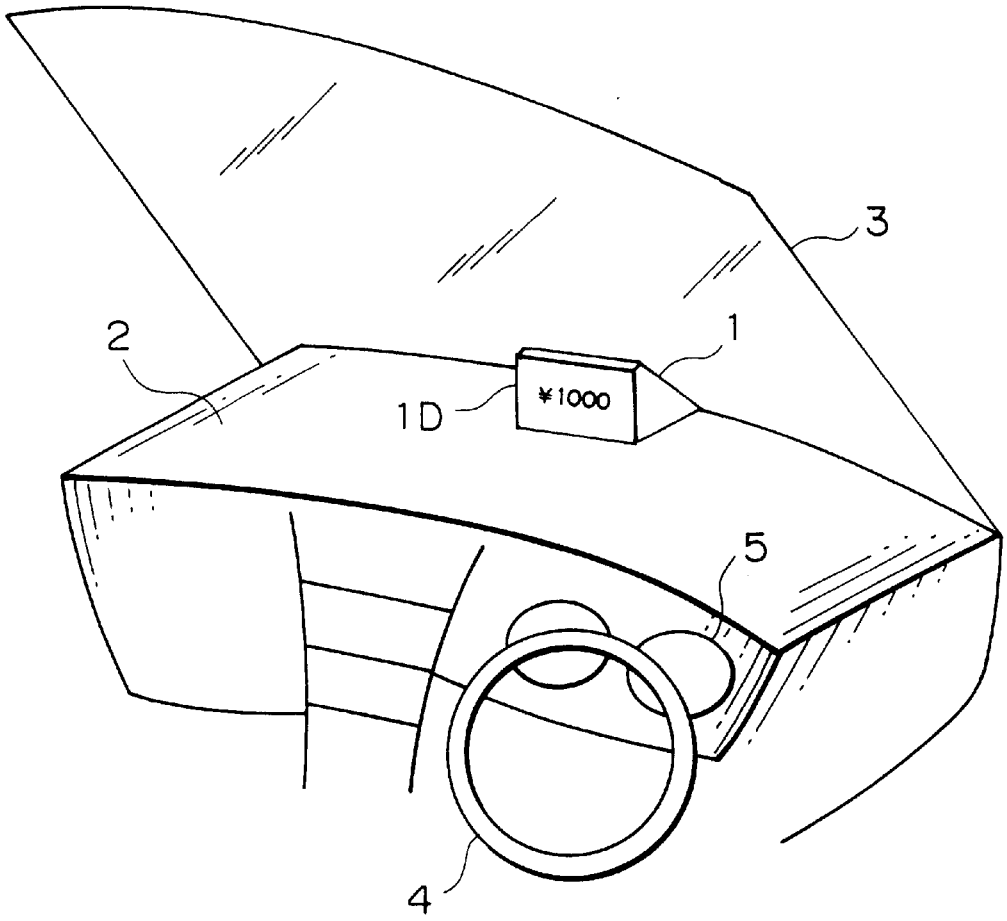
FIG. 2 is a perspective view showing an installation state of an on-board DSRC apparatus, when viewed from the inside of a vehicle, according to a third embodiment of the present invention.

In addition, while in the above-mentioned first embodiment, the dielectric part 9 is provided between the on-board apparatus 1 and the front glass part 3, alternatively, the case of the body itself of the on-board apparatus 1 may also be made as the positioning means to be adhered closely to the inner wall of the front glass part 3 as shown in FIG. 2.

FIG. 2 is a perspective view showing the installation state of an on-board DSRC apparatus, when viewed from the inside of the vehicle, according to a third embodiment of the present invention wherein the on-board apparatus 1. is adhered closely to the front glass part 3. In FIG. 2, parts similar to those previously described with reference to FIG. 1 are designated by the same reference numerals and the detailed description thereof is omitted here for the sake of simplicity.

In the present embodiment, since the same operation and effects as those in the foregoing are obtained and also the dielectric part 9 (refer to FIG. 1) becomes unnecessary, the reduction of the cost of the on-board apparatus can also be realized.

While in the present embodiment, the antenna 1A which is integrated with the on-board apparatus 1 is adhered closely to the front glass part 3, alternatively, for example, in the on-board apparatus in which the body of the on-board apparatus is separated from the antenna 1A (it is in general referred to as "the three-pieces type of on-board apparatus"), only the antenna 1A may be adhered closely to the front glass part 3. In this case, the same operation and effects as those of the foregoing are obtained.

In addition, in the case where only the on-board 1A is adhered closely to the front glass part 3, since the antenna 1A is smaller than the on-board apparatus 1, the obstruction to the field of view of a driver can be suppressed to a minimum as compared with the case where the on-board apparatus 1 is adhered closely to the inner wall of the front glass part.

(Fourth Embodiment)

In this connection, while in the above-mentioned first embodiment, the description has: been given with respect to the specific case where the on-board apparatus 1 is installed on the dash-board 2 after having purchased a vehicle, in the case where the on-board apparatus 1 is previously embedded in the dash-board 2, the printing display unit may also be provided on the upper face of the dash-board 2 corresponding to the position where the on-board apparatus 1 is embedded.

Figure 3:
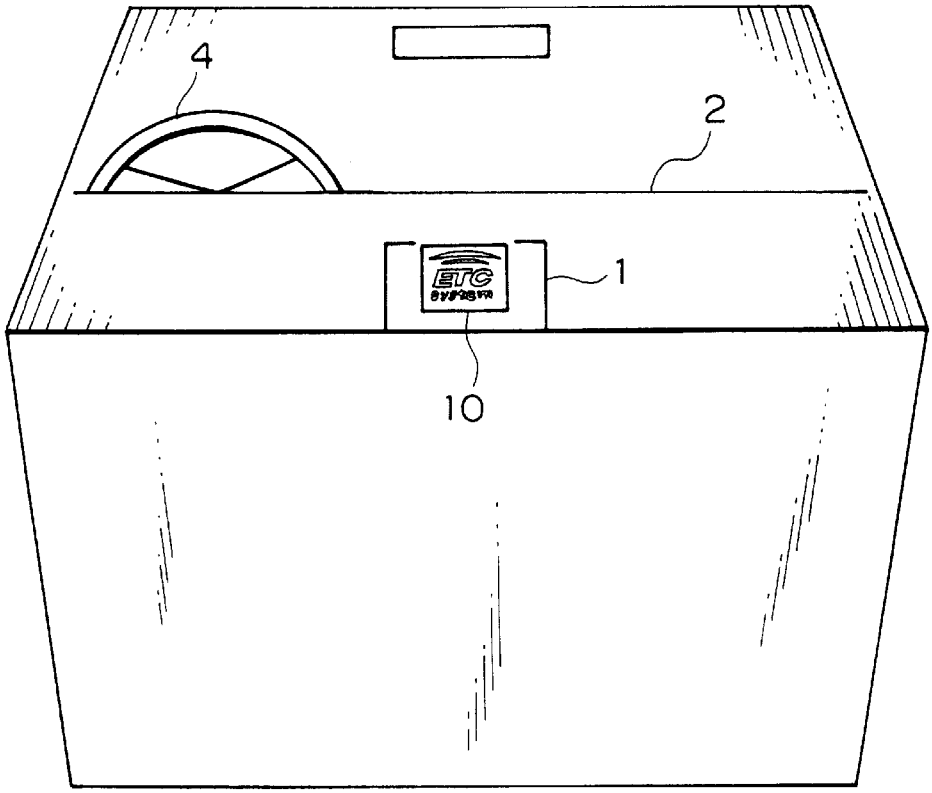
FIG. 3 is a front view showing a peripheral state of an on-board DSRC apparatus, when viewed from the outside of a vehicle, according to a fourth embodiment of the present invention.

FIG. 3 is a front view showing the peripheral state of an on-board apparatus 1, when viewed from the outside of the vehicle, according to the fourth embodiment of the present invention wherein a printing display unit 10 is provided. In FIG. 3, parts similar to those previously described with reference to FIG. 1 are designated by the same reference numerals and the detailed description thereof is omitted here for the sake of simplicity.

Figure 4:
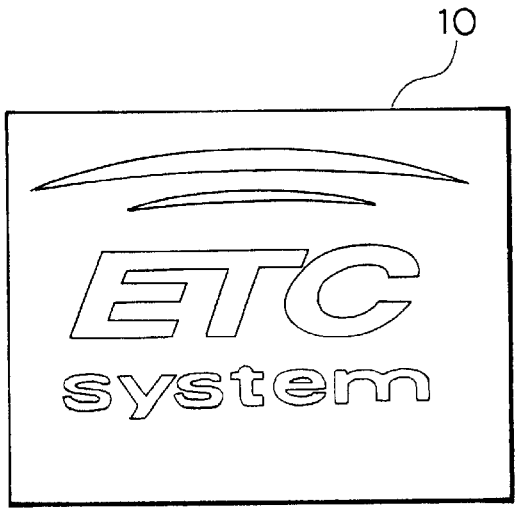
FIG. 4 is an enlarged plan view showing a printing display unit of the on-board DSRC apparatus according to the fourth embodiment of the present invention.

In addition, FIG. 4 is an enlarged plan view showing the printing display unit 10.

In this case, while the on-board apparatus 1 is embedded in the dash-board 2, the printing display unit 10 for urging a driver to pay attention thereto is provided on the upper face of the dash-board 2.

Therefore, since a driver is prevented from placing carelessly a baggage on the upper part of the on-board apparatus 1, the antenna characteristics are not degraded at all.

In addition, as shown in FIG. 3, since the printing display unit 10 which is provided on the upper face of the dash-board 2 can also be viewed from the outside of the vehicle, the propaganda effect can be obtained and a sense of superiority over to other drivers may be given to the user.

(Fifth Embodiment)

In this connection, while in the above-mentioned fourth embodiment, the printing display unit 10 is provided on the upper face of the on-board apparatus 1 which is embedded in the dash-board 2, even in the on-board apparatus 1 which is installed on the dash-board 2 (refer to FIG. 1), the same printing display unit may also be provided on the surface of the dielectric part 9 facing a driver in order to urge a driver to pay attention thereto.

(Sixth Embodiment)

In addition, while in the above-mentioned fourth embodiment, only the printing display unit 1:0 is provided on the upper face of the dash-board 2 corresponding to the position where the on-board apparatus 1 is embedded, alternatively, a projecting member (not shown) may, instead thereof, be provided in the position corresponding to the upper part of the on-board apparatus 1 (the antenna 1A).

In such a way, the projecting member is provided, whereby even when a driver wants to place carelessly a baggage on the upper face of the on-board apparatus 1, the baggage can be excluded through the projecting member.

In addition, the on-board apparatus 1 is accommodated in the dash-board 2, whereby the number of wiring lines distributed for a power source and the like can be reduced, and also it is possible to realize the dash-board 2 having a high stage of completion.

In addition, the dash-board 2 is provided with the projecting member, whereby the volume in which the on-board apparatus 1 is accommodated can be ensured and also the efficiency of utilizing the dash-board 2 can be enhanced.

In this connection, the projecting member may also be provided only in the peripheral part of the antenna 1A.

In addition, in this case, similarly to the foregoing, the matching may also be obtained for the antenna 1A in the dash-board 2 by taking a dielectric constant and the like of the projecting member into consideration.

In addition, the display unit 1D may also be arranged on the front face (the surface facing a driver) of the projecting member to ensure the visibility of the display.

Also, the printing display unit which is similar in construction to the foregoing (refer to FIG. 3) may also be provided on the surface of the projecting member facing a driver.

Further, if the projecting member on the dash-board 2 in which the on-board apparatus 1 is embedded is projectingly provided up to the position which reaches the front glass part 3, the space in which a baggage is wanted to be placed is not defined between the upper part of the on-board apparatus 1 and the front glass part 3. As a result, the degradation of the antenna characteristics due to the interposition of an object can be surely prevented.

While the present invention has been particularly shown and described with reference to the preferred embodiments and the specified modifications, it will be understood that the various changes and other modifications will occur to those skilled in the art without departing from the scope and true spirit of the invention. The scope of the invention is therefore to be determined solely by the appended claims.

What is claimed is:

1. An on-board DSRC apparatus including an antenna and a control unit for communicating with the associated one of on-road communication machines which is installed on a travelling road of a vehicle and being installed in the vicinity of a dash-board of a vehicle, wherein positioning means is provided between said antenna and a front glass part of a vehicle so that a distance between said antenna and said front glass part of said vehicle is set to a fixed value; wherein said antenna is installed on said dash-board of said vehicle and said positioning means is provided up to the position which reaches said front glass part of said vehicle.

2. An on-board DSRC apparatus according to claim 1, wherein said positioning means is comprised of a dielectric part having a predetermined dielectric constant so that the antenna characteristics are ensured to predetermined values.

3. An on-board DSRC apparatus according to claim 2, wherein the matching is obtained for said antenna of said on-board DSRC apparatus by taking a thickness and a dielectric constant of said dielectric part into consideration.

4. An on-board DSRC apparatus according to claim 1, wherein said positioning means is projectingly provided in said on-board DSRC apparatus in such a way as to be located in the vicinity of the peripheral part of said antenna.

5. An on-board DSRC apparatus according to claim 1, wherein said positioning means has a printing display part on the surface facing a driver of said vehicle.

6. An on-board DSRC apparatus according to claim 1, wherein said on-board DSRC apparatus is installed in such a way as to be adhered closely to an inner wall of said front glass part of said vehicle via said positioning means.

7. An on-board DSRC apparatus according to claim 1 wherein said control unit transmits and receives information relating to the charge collection to and from the associated one of the on-road communication machines for charge collection to carry out automatically the charge collection on the basis of the information relating to the charge collection.

8. An on-board DSRC apparatus including an antenna and a control unit for communicating with the associated one of on-road communication machines which is installed on a travelling road of a vehicle and being installed in the vicinity of a dash-board of a vehicle, wherein said antenna is embedded in said dash-board, and said dash-board has a projecting member on a upper face corresponding to the position where said antenna is embedded.

9. An on-board DSRC apparatus according to claim 8, wherein said projecting member is provided in the position corresponding to the peripheral part of said antenna.

10. An on-board DSRC apparatus according to claim 8, wherein said projecting member has a printing display unit on the surface of said vehicle facing a driver.

11. An on-board DSRC apparatus according to claim 8, wherein said control unit transmits and receives information relating to the charge collection to and from the associated one of the on-road communication machines for charge collection to carry out automatically the charge collection on the basis of the information relating to the charge collection.

12. An on-board DSRC apparatus including an antenna and a control unit for communicating with the associated one of on-road communication machines which is installed on a travelling road of a vehicle and being installed in the vicinity of a dash-board of a vehicle, wherein said antenna is embedded in said dash-board, and said dash-board has a printing display unit on a upper face corresponding to the position where said antenna is embedded.

13. An on-board DSRC apparatus according to claim 12, wherein said control unit transmits and receives information relating to the charge collection to and from the associated one of the on-road communication machines for charge collection to carry out automatically the charge collection on the basis of the information relating to the charge collection.

14. An on-board DSRC apparatus including an antenna and a control unit for communicating with the associated one of on-road communication machines which is installed on a travelling road of a vehicle and being installed in the vicinity of a dash-board of a vehicle, wherein positioning means is provided between said antenna and a front glass part of a vehicle so that a distance between said antenna and said front glass part of said vehicle is set to a fixed value; wherein said positioning means has a printing display part on the surface facing a driver of said vehicle.

15. An on-board DSRC apparatus including an antenna and a control unit for communicating with the associated one of on-road communication machines which is installed on a travelling road of a vehicle and being installed in the vicinity of a dash-board of a vehicle, wherein positioning means is provided between said antenna and a front glass part of a vehicle so that a distance between said antenna and said front glass part of said vehicle is set to a fixed value; wherein said on-board DSRC apparatus is installed in such a way as to be adhered closely to an inner wall of said front glass part of said vehicle via said positioning means.

* * * * *